United States Patent [19]

Dayus

[11] Patent Number: 4,513,655

[45] Date of Patent: Apr. 30, 1985

[54] DAMPER AND BLADE THEREFOR

[76] Inventor: Lloyd G. Dayus, 1735 Mattawa Ave., Mississauga, Ontario, L4X 1K5, Canada

[21] Appl. No.: 556,557

[22] Filed: Nov. 30, 1983

[51] Int. Cl.[3] ..... F24F 13/08

[52] U.S. Cl. ..... 98/121.2; 49/78

[58] Field of Search ..... 98/121 A, 110; 137/601; 49/81, 74, 77, 78

[56] References Cited

U.S. PATENT DOCUMENTS

| | | | |
|---|---|---|---|
| 2,780,983 | 2/1957 | De Roo | 49/78 |
| 3,125,944 | 3/1964 | Radcliff | 49/78 |
| 3,196,895 | 7/1965 | Dayus | 49/78 |
| 3,741,102 | 6/1973 | Kaiser | 98/121 A |
| 3,800,688 | 4/1974 | Parrish | 98/110 |

*Primary Examiner*—Henry C. Yuen
*Assistant Examiner*—John Kwon

[57] ABSTRACT

An air damper having a frame, blade support strips on opposite sides, having blade pivot pins extending at spaced intervals, blade members extending from side to side and having pin receiving recesses at opposite ends for receiving pins on the support strips, a blade linkage member on at least one side, extending adjacent to the ends of the blades, guides on the frame, interengaging with the linkage member for sliding linear movement, and blade engaging members on the linkage member for respective blades, movement of the linkage member moving all the blades simultaneously.

9 Claims, 8 Drawing Figures

DAMPER AND BLADE THEREFOR

The invention relates to air flow control dampers for use in air handling systems.

BACKGROUND OF THE INVENTION

Air control dampers commonly involve construction based on a generally rectangular frame, and a plurality of parallel blades extending from side to side across the frame. The blades are hinged or pivotally mounted in the frame, so that they may be swung between closed and open positions. It is thus possible to regulate and to restrict and control air flow at the outlet or inlet.

It is normal to provide a movement linkage inter-connecting all of the blades so that they all may be moved in unison. Some form of tool, or key, is usually used to operate the linkage, and the linkage is usually provided with a tool receiving recess or other like receiver, by means of which the key may readily be inter-engaged with the linkage.

The dimensions of such air dampers vary dependent upon the size of the air duct or air opening which they are intended to control. Certain standard sizes may be held in stock. However, in some cases it may not be possible to stock standard air dampers in a sufficient range of sizes. Sizes may not be known until an order is received. Various quantities of dampers in different sizes are specified, and then production is commenced.

The steps involved in production usually entail cutting lengths of material to form the frame, cutting blades to the appropriate length, fitting the blades within the frame, interengaging the linkage mechanism, and blade pivots, and fastening the frame portions together at their corners.

The design and construction of the blades has involved either a solid extrusion of aluminum or roll-formed steel or aluminum. In order to reduce expense of the material, it has been proposed to use a thin sheet material which may be formed into a blade section. Various different blade section formations may be roll formed in this way.

The blade pivots may be formed by cutting notches at the ends of the blades. Alternatively, pivot members are attached to the blade ends. These pivots are usually then received in holes in the sides of the frame. The formation of the blades therefore involves several different manufacturing steps, and the assembly of the blades and the frame also involves a number of assembly steps, and the use of a number of different components.

Much of this work must be done by hand labour. Consequently, the fabricating of such air dampers is a relatively inefficient and expensive operation. As a result this significantly increases the cost of the dampers.

Clearly, it is desirable to provide an improved damper construction, wherein much of the hand fabrication techniques are eliminated, and which are particularly suitable to the fabrication of dampers in a wide variety of different sizes, using standardized materials, and a minimum of hand labour.

BRIEF SUMMARY OF THE INVENTION

With a view to overcoming this various disadvantages, the invention therefore comprises an air damper having a generally rectangular frame, blade retaining strip members on opposite sides of said frame, said strip members being of generally regular shape along their length and having a plurality of blade pivot pins extending normal thereto at spaced apart intervals therealong, a plurality of generally linear blade members extending from side to side in said frame, said blade members having pin receiving recesses at opposite ends thereof for receiving pins on said retaining strip members, whereby said blade members may be pivoted with respect to said frame between open and closed positions, and, a blade linkage strip on at least one side of said frame, extending adjacent to the ends of said blades on said side of said frame, guide means on said side of said frame, for interengaging with said linkage strip, and guiding the same for sliding linear movement relative to said side of said frame, said linkage strip defining blade engaging formations extending into engagement with respective said blades, movement of said blade linkage strip being communicated thereby to all the said blades simultaneously, for causing simultaneous pivotal movement of said blades on said pivot pins.

More particularly, the invention provides such a damper construction wherein the blade linkage strip defines a plurality of blade engaging rod members extending normal to such linkage strip at spaced apart intervals, such rod members being offset towards opposite edges of such strip, whereby such rods members engage their respective said blade members in alternate upper and lower positions, thereby procuring pivotal movement of their respective blade members in alternate clockwise and anti-clockwise direction.

More particularly, the invention comprises such a damper construction wherein the linkage strip defines a guide means such as a rib or groove, for guiding a respective said blade mounting strip, said blade mounting strip having a length greater than such linkage strip, whereby when such linkage strip is moved, such mounting strip is held against movement.

More particularly, the invention provides such a damper construction wherein the linkage strip incorporates tool receiving means, for operation by means of a suitable tool.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
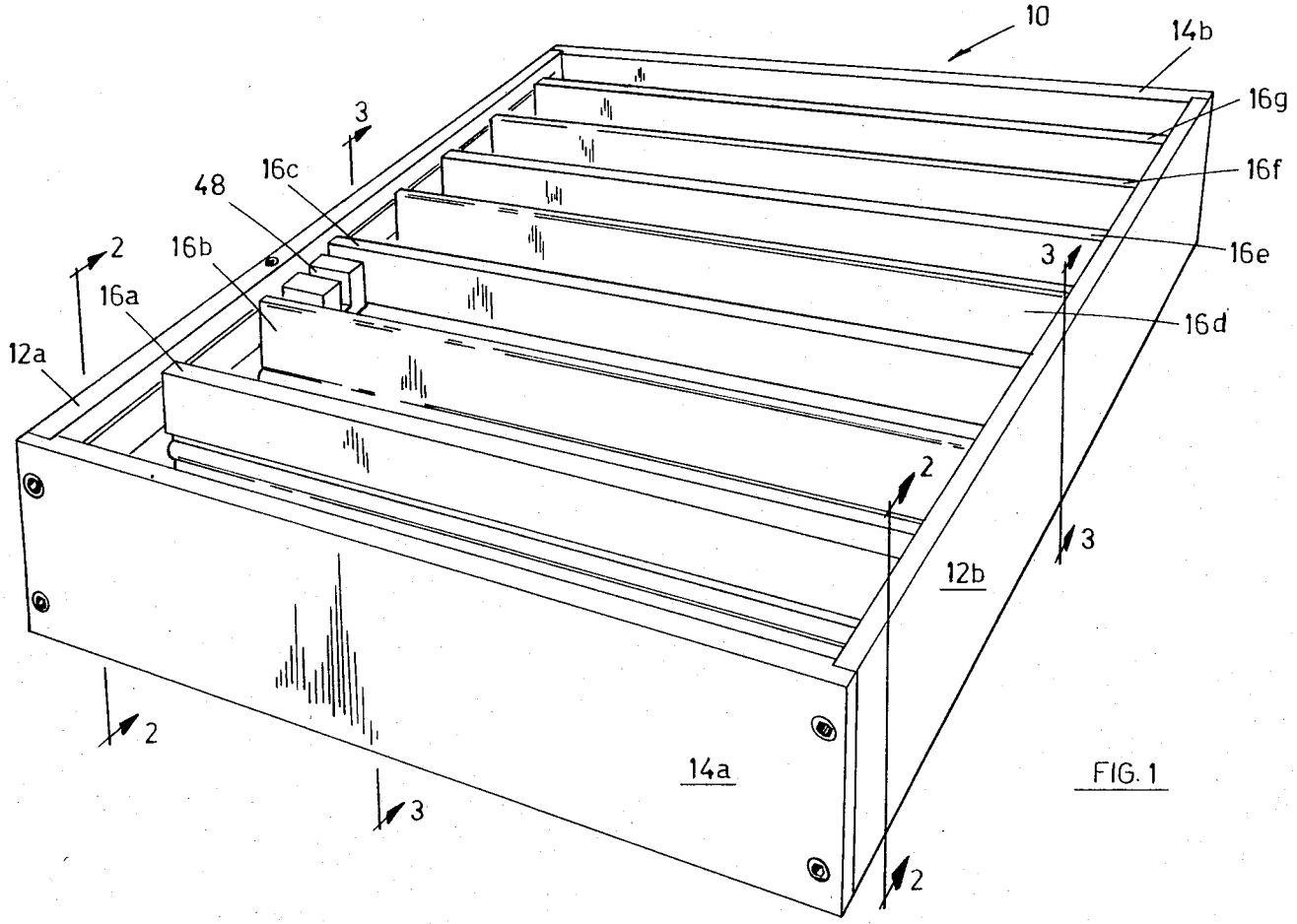
FIG. 1 is a perspective illustration showing a typical air damper constructed according to the invention.
Figure 2:
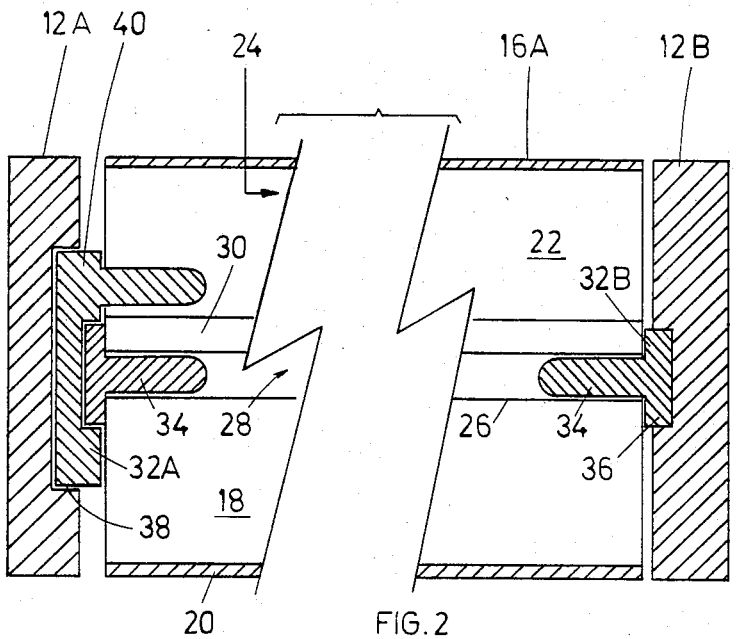
FIG. 2 is a section along the line 2—2 of FIG. 1.
Figure 3:
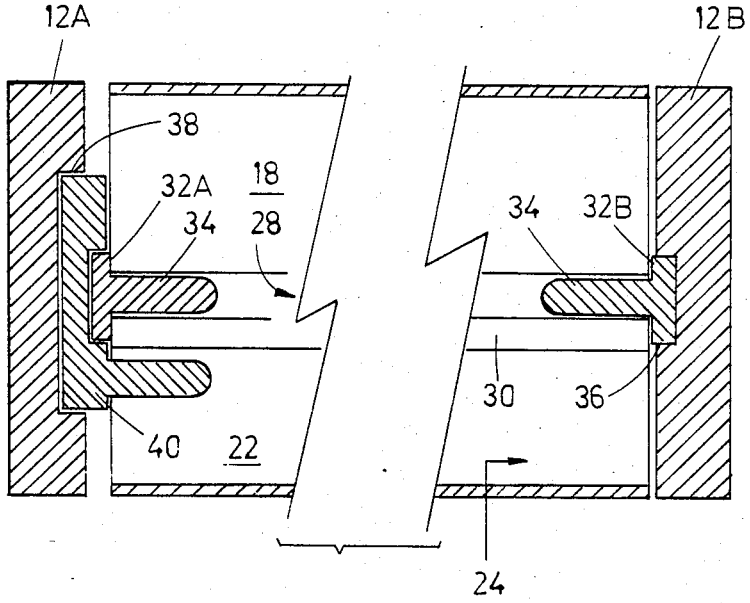
FIG. 3 is a section along the line 3—3 of FIG. 1.

Referring first of all to FIG. 1, the invention will be seen to relate generally to a damper indicated as 10. Such dampers are usually used in conjunction with rectangular air grilles, and must therefore conform essentially to the height and width of the grille. They are usually incorporated in a frame portion of the grille, which is usually mounted in the floor, ceiling or wall or any suitable part of the fabric of a building or other location where air inlet or outlet facilities are provided.

It will be appreciated that the air dampers described may be installed at other locations. The grille frame may for convenience incorporate integral frame portions for such dampers. For the sake of simplicity, however, the damper frame is shown here as separate from the grille.

The damper frame has side members 12—12 and 12*a* and 12*b*, and end members 14*a*, 14*b*. Typically, such a frame may be made of roll formed or extruded aluminum, or roll formed steel, which may or may not be provided with additional ribs and flanges (not shown) for stiffness, fastening and the like. The details of such frame may vary widely from one manufacturer to another and are in any event believed to be essentially irrelevant for the purposes of this invention. For the purposes of these illustrations therefore, the frame is shown as formed of a solid metal strip, although in practice it will of course be appreciated that this will be replaced by a formed section for the sake of economy in material, weight and the like. Such a frame is joined at the corners by any suitable joining means. In the particular case shown the frame is shown as joined together at the corners by screws. In practice however this would be impracticable. End portions of the frame might be bent over, or alternatively additional end connector brackets might be used. The details of such bent over flanges, or end connectors are essentially well known in the art and require no further description.

Within the frame, there are mounted a plurality of air control blades 16*a*, 16*b*, 16*c*, etc.

Figure 4:
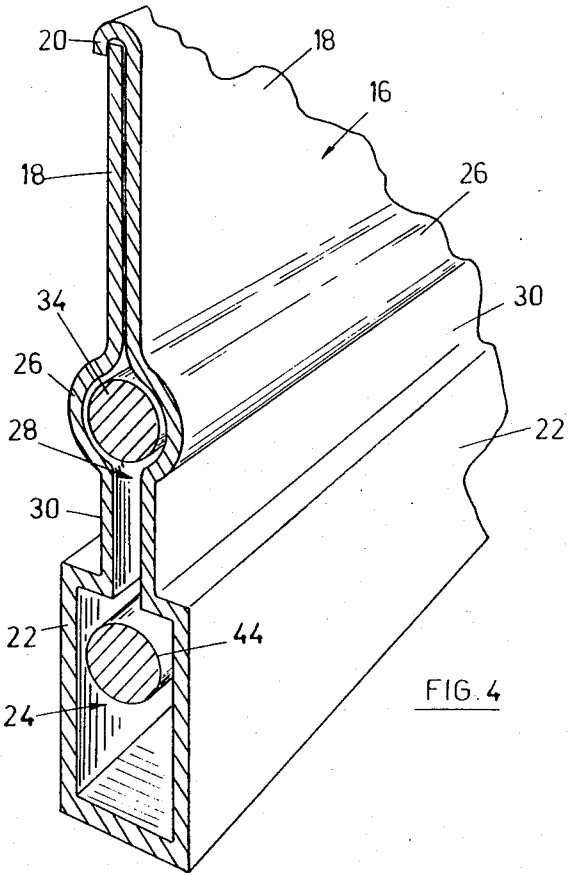
FIG. 4 is a cut away perspective of a blade.

The blades 16 are shown in more detail in FIG. 4. They will be seen to be of thin sheet metal roll formed construction. Each of blades 16 comprises a double wall, and portions of said wall are folded closely together as at 18, into contact with one another, to form a generally thin section, and a portion of such walls as at 20 is rolled over to hold the two wall portions 18 together.

Along the opposite edge of the blade 16, the blade is formed of two wall portions 22 which are located spaced apart from one another to define a hollow interior 24. The configuration of the blade folds is shown as being generally rectangular. It will, however, be appreciated that this is essentially only for the purposes of illustration. The blade shaping at the various folds could be of any desired shape suitable for the purpose.

The blades 16 define a central axial semicylindrical wall portion 26, in the opposite sides of such blades which together define a generally cylindrical axial recess 28.

Between the recess 28 and the recess 24, further wall portions 30 are squeezed or brought as close together as possible, for reasons to be described in more detail below.

Referring once again to FIG. 1, it will be seen that the blades 16*a*, *b*, etc. are mounted in an essentially alternate fashion. Thus the blade 16*a* is shown with its wide wall portions 22 uppermost, and the next adjacent blade 16*b* is shown with its closely adjacent wall portions 18 uppermost.

Successive blades 16*c*, *d*, etc. have wall portions c, d, etc. alternate 18–22 alternating in the same fashion.

In order to provide for a pivotal mounting of the blades 16 within the frame, a pair of blade mounting strips 32*a*, 32*b*, are provided on opposite sides of the frame. Each of the blade mounting strips 32 is of generally thin flat elongated linear construction, and is provided with a plurality of blade pivot pins 34 extending normally thereto at spaced apart intervals.

The blade mounting strip 32*a* on the side frame member 12*b*, is received in a generally axial slide retaining groove 36, formed on the inner surface of the side frame member. It will of course be appreciated the use of such a groove 36 is but one of various means whereby the strip 32*a* may be fastened in position.

Side frame member 12*a* has an axial groove 38 somewhat larger than groove 36 in frame 12*b*. In order to provide for movement of the blades 16 in unison, a blade linkage strip 40 is provided which is slidably received in groove 38 of side frame member 12*a*.

Figure 5:
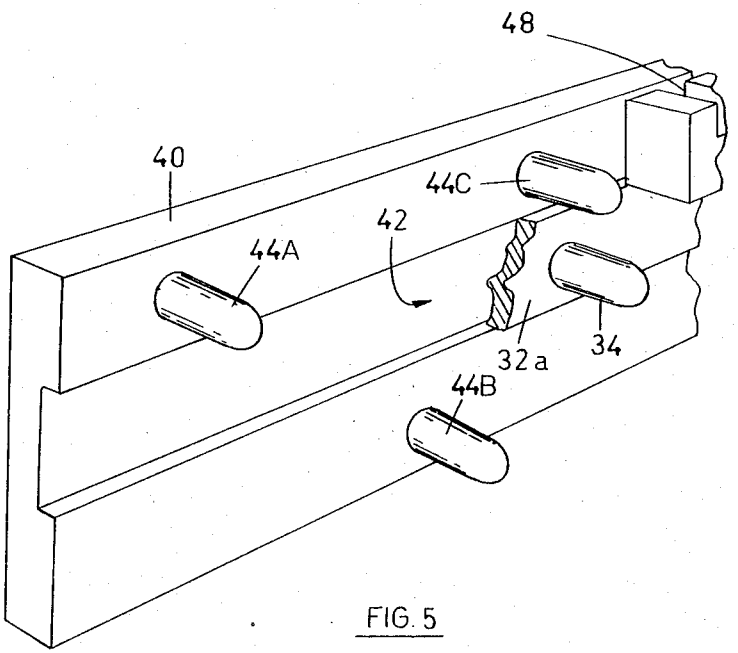
FIG. 5 is a cut away perspective of the blade linkage and mounting strips.

As best shown in FIG. 5, the strip 40 will be seen to comprise a generally flattened elongated linear member, defining a central axial slide recess 42. Received within the recess 42 is the blade support member 32*a*, corresponding to the blade support member 32*b* on the opposite side of the damper.

The linkage strip 40 is provided with a plurality of blade engaging means, in this case in the form of the spaced apart rods 44. The rods 44 are designed to fit within the recesses 24 of the respective blade members 16. It will be observed that the rods 44 are offset to opposite side edges of the strip 40. Thus the rod member 44*a* is shown along the upper edge, and the rod member 44*b* along the lower edge and so on.

The strip 40 is cut somewhat shorter than the strip 32*a* for reasons to be described.

Both the strip 40 and the strips 32*a* and 32*b* are preferably formed of a suitable thermo plastic material, having suitable self-lubricating qualities, and being capable of extended working life, and being resistant to the type of conditions and temperatures found in conditioned air systems, where such a damper is to be used in such a system.

The blade linkage strip 40 is slidable within the groove 38 in side member 12*a*, so that it may be slid to and fro. Similarly, linkage strip 40 is slidable relative to its associated mounting strip 32*a*, which remains stationary.

In many cases it will be possible to operate the blades 16, simply by engaging one of the blades 16 with a suitable tool such as a screw driver.

However, it is desirable to provide for a tool receiving means. In this case it is shown in the form of a notch 48 formed in the slide member 40. If desired suitable recess 50 may be located on the adjacent side frame member. In this way a tool or key may be interengaged between them and simply rotated.

The operation of the device is believed to be self evident from the foregoing description and drawings. The blades 16 would normally be in the wide open position, i.e. swung into parallel planes, parallel with the upper and lower frame members 14*a*, 14*b*.

If it was desired to reduce the flow of air, maintenance personnel would simply move the blade linkage member 40 relative to the side frame member 12*a*.

This will cause simultaneous pivotal movement of each of the blades 16*a*–*b*, etc. in respective clockwise and anti-clockwise direction. The blades will of course be secured at their pivot axes against lateral displacement. The blade support strips 32*a*, 32*b* are essentially the same length as the interior length of the side frame members 12*a* and 12*b* and cannot therefore slide.

Thus it will be understood that the linkage member 40 slides relative both to the frame member 12*a* and also to the support member 32*a*.

If desired, two such linkage members may be provided, one at each end of the blades, although in the majority of cases this will not be necessary.

By suitably dimensioning the pivot pins 34, and by selection of the appropriate thermoplastic material, and by fabricating the blade members 16 with the recesses 28 of the appropriate diameter, a suitable degree of frictional engagement can be maintained such that once set in a predetermined position, the blade member 16 will remain set until again moved by service personnel.

Figure 6:
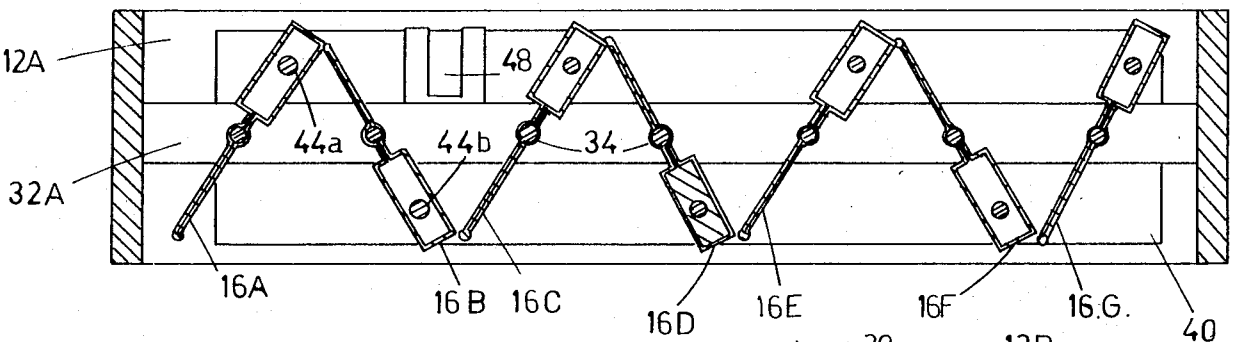
FIG. 6 is a schematic side view showing the operation of the damper.

FIG. 6 illustrates in schematic form the position of the blade members when closed.

Figure 7:
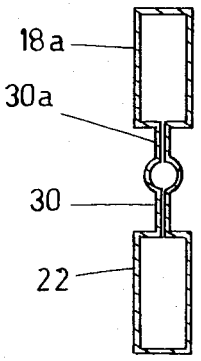
FIG. 7 is a section of an alternate form of blade.

An alternate form of blade is shown in FIG. 7. In this form the closed wall portions 18 are replaced by spaced wall portions 18*a* and closed intermediate portions 28*a* similar to wall portions, 22, 28. This form may simplify assembly in some circumstances.

While the embodiment illustated is in the form of a frame with guide grooves 36–40 of different widths, it would be possible to make them of the same width, and thus use a uniform shaped frame member all round the frame.

Figure 8:
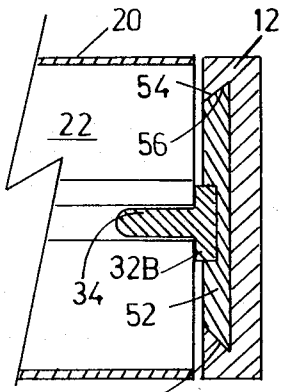
FIG. 8 is a section of an alternate form of side member.

As shown in FIG. 8, this would enable the use of a standard extrusion for all frame side members.

In this case a liner or spacer 52 would be used in the groove 38*b* of side 12*b* of the frame opposite to the blade linkage strip 40.

Alternatively, a modified form of blade support strip would be required on that side so as to fit the groove.

FIG. 8 also illustrates wedge shaped edges 54 on groove 38*b*, and angled edges 56 on the strip 52. This serves to retain the strip in the groove. Similar formations could be used on strips 32*a* and 32*b*, and their corresponding grooves.

The foregoing is a description of a preferred embodiment of the invention which is given here by way of example only. The invention is not to be taken as limited to any of the specific features as described but comprehends all such variations thereof as come within the scope of the appended claims:

What is claimed is:

1. An air damper comprising;

a generally rectangular frame;

blade support members on opposite sides of said frame of predetermined width and thickness;

a plurality of blade pivot pins extending normal to each such support member at spaced apart intervals therealong;

a plurality of generally linear blade members extending from side to side in said frame, said blade members having pin receiving recesses at opposite ends thereof for receiving pins on said supporting strip members, whereby said blade members may be pivoted with respect to said frame between open and closed positions;

a blade linkage member on at least one side of said frame located between a said blade support member and an adjacent portion of said frame, extending adjacent to the ends of said blades on said side of said frame, said linkage member being slidably movable relative to said side of said frame and defining receiving means for engaging said blade support member, and, blade engaging formations extending from such linkage member around said blade support member into engagement with respective said blade members, movement of said blade linkage member being communicated thereby to all the said blade members simultaneously, for causing simultaneous pivotal movement of said blade members on said pivot pins wherein the linkage member defines a guide groove for receiving a respective said blade mounting member therein, said blade mounting member having a length greater than such linkage member, whereby when such linkage member is moved, such blade mounting member is held against movement.

2. An air damper as claimed in claim 1 wherein the blade linkage member defines a plurality of blade engaging rod members extending normal to such linkage member at spaced apart intervals, such rod members being offset towards opposite edges of such linkage member, whereby such rod members engage their respective said blade members in alternate upper and lower positions, thereby procuring pivotal movement of their respective blade members in alternate clockwise and anti-clockwise direction.

3. An air damper as claimed in claim 1 wherein said linkage strip incorporates tool receiving means, for operation by means of a suitable tool.

4. An air damper as claimed in claim 1 wherein said blade linkage member defines an axial groove, and wherein one said blade support member fits in said groove.

5. An air damper as claimed in claim 1 wherein said blade linkage member is shorter than said side of said frame, and including guide means for such linkage member to permit sliding movement.

6. An air damper as claimed in claim 1 wherein said sides of said frame define axial formations for supporting said blade support members and said blade linkage member.

7. An air damper as claimed in claim 6 wherein said axial formations are recesses.

8. An air damper as claimed in claim 7 wherein said blade linkage member is slideably received in one said recess and defines a groove, one said blade support member being received in said groove.

9. An air damper as claimed in claim 8 wherein said recesses in said frame are of the same size, and including a filler strip in one said axial recess, and a further groove in said filler strip for receiving the other of said blade support members.

* * * * *